United States Patent [19]

Kloster et al.

[11] 4,037,645

[45] July 26, 1977

[54] AUTOMATIC MOLD AND CORE FORMING MACHINE

[75] Inventors: William R. Kloster, Muscatine, Iowa; Patrick H. Stewart, Danville, Ill.

[73] Assignee: C L Industries, Inc., Danville, Ill.

[21] Appl. No.: 688,698

[22] Filed: May 21, 1976

Related U.S. Application Data

[63] Continuation of Ser. No. 529,902, Dec. 5, 1974, abandoned, which is a continuation-in-part of Ser. No. 445,485, Feb. 25, 1974, abandoned.

[51] Int. Cl.[2] ..... B22C 13/02; B22C 15/02; B22C 17/00

[52] U.S. Cl. ..... 164/161; 164/183; 164/207; 164/224

[58] Field of Search ..... 164/194, 208, 167, 278, 164/279, 276, 181, 183, 161, 207; 425/DIG. 201

[56] References Cited

U.S. PATENT DOCUMENTS

| | | | |
|---|---|---|---|
| 1,108,694 | 8/1914 | Burkhardt | 164/208 X |
| 1,119,680 | 12/1914 | Brown | 164/167 |
| 1,761,065 | 6/1930 | Bausman | 425/447 X |
| 3,840,063 | 10/1974 | Staley | 164/194 |

*Primary Examiner*—Francis S. Husar
*Assistant Examiner*—John S. Brown
*Attorney, Agent, or Firm*—Cushman, Darby & Cushman

[57] ABSTRACT

An automatic mold and core forming machine is described wherein an endless chain conveyor is in engagement with a plurality of flasks carriers for movement therewith with a mold material retaining means positioned adjacent and end of the chain conveyor and arranged to contact the material in the flasks and retain it therein as the flasks are inverted in passage around the conveyor. A flask filling and compacting assembly is provided adjacent the opposite upper end of the chain conveyor for automatically filling and compacting the flasks as they pass thereunder and a mold draw station is provided at the underside of the chain conveyor.

11 Claims, 7 Drawing Figures

AUTOMATIC MOLD AND CORE FORMING MACHINE

CROSS REFERENCE TO RELATED APPLICATIONS

This application is a continuation application of Ser. No. 529,902, filed Dec. 5, 1974, now abandoned which in turn is a continuation-in-part application of Ser. No. 445,485, filed Feb. 25, 1974, now abandoned.

BACKGROUND AND SUMMARY OF THE INVENTION

The present invention is directed to field of apparatus for the forming of sand cores and molds for use in casting of metals in foundries. The general concepts involved in the formation of such molds for the casting of metal are so well known as to not require any specific description of the priniciples.

Preparation of sand molds and cores for the metal casting industry have a number of desirable goals. Among these are the following:

The process should be one of continuous operation so that any stop and start motion throughout the system is minimized and preferably totally eliminated. As is known the quantity of binder that must be added to sand in the forming of such molds depends to a degree upon the speed with which the sand is utilized after blending. The placement of sand-binders into molds substantially immediately after blending permits use of minimum amounts of binder to sand ratio thus decreasing costs. While not limited thereto, it is contemplated that the apparatus of the invention will find its principal use in conjunction with so-called no-bake binders. However, other binders may be used which makes use of microwave curing, heat or chemical treatment to bring about cure as well as the use of the preferred no-bake binders.

The equipment which is involved in preparing such sand molds also desirably occupies as small an amount of floor space as possible.

In accordance with the present invention, apparatus is provided utilizing an endless chain type conveyor system which moves a plurality of pattern carriers or mold boxes about the endless conveyor. At the upper portion of the conveyor, the appropriate patterns are inserted in the pattern carriers and then through the use of a sand filling arrangement, flasks surrounding the patterns are filled with a sand-binder mix. The movement of the chain carries the flask along beneath the filling apparatus and at a predetermined point a scraper or strike-off member is actuated to sweep across the surface of the mold to provide a uniform level of semi-compacted sand. The excess sand is swept into the following flask which is then subsequently filled as it passes beneath the sand spout. The filled flask then progresses along the endless conveyor through such additional processing steps as are required for compacting and removal of excess or loose sand — such as tamping and sweeping. Cure accelerating means may also be used as the now filled flasks progress along the upper course of the conveyor. As the now filled and open topped flask begins to turn about the end wheel of the endless conveyor, the sand-binder surface is engaged by a holding means such as second belt conveyor which has a synchronous movement with the flask and chain drive so that it provides at least in partial a closure for the top of the flask holding the partially set sand-binder mixture within the flask. In the preferred embodiment, this endless belt then continues in engagement with the open and inverted end of the flask as the flask passes beneath the lower course of the endless chain conveyor. After the sand-binder mix is set sufficiently to retain its shape, a draw station is passed wherein the sand mold is removed from the flask and passes along the conveyor to a next work station.

The invention will be best understood in conjunction with the following drawings wherein:

IN THE DRAWINGS

DETAILED DESCRIPTION OF THE INVENTION

The invention will be described in connection with the preparation of a cope although it should be understood that the apparatus is equally adaptable to formation of cores and drag members. These can be readily formed by placing different patterns with the flask. If desired, one may use mixes of flasks on the conveyor so as to produce cope, drag and cores sequentially.

Figure 1:
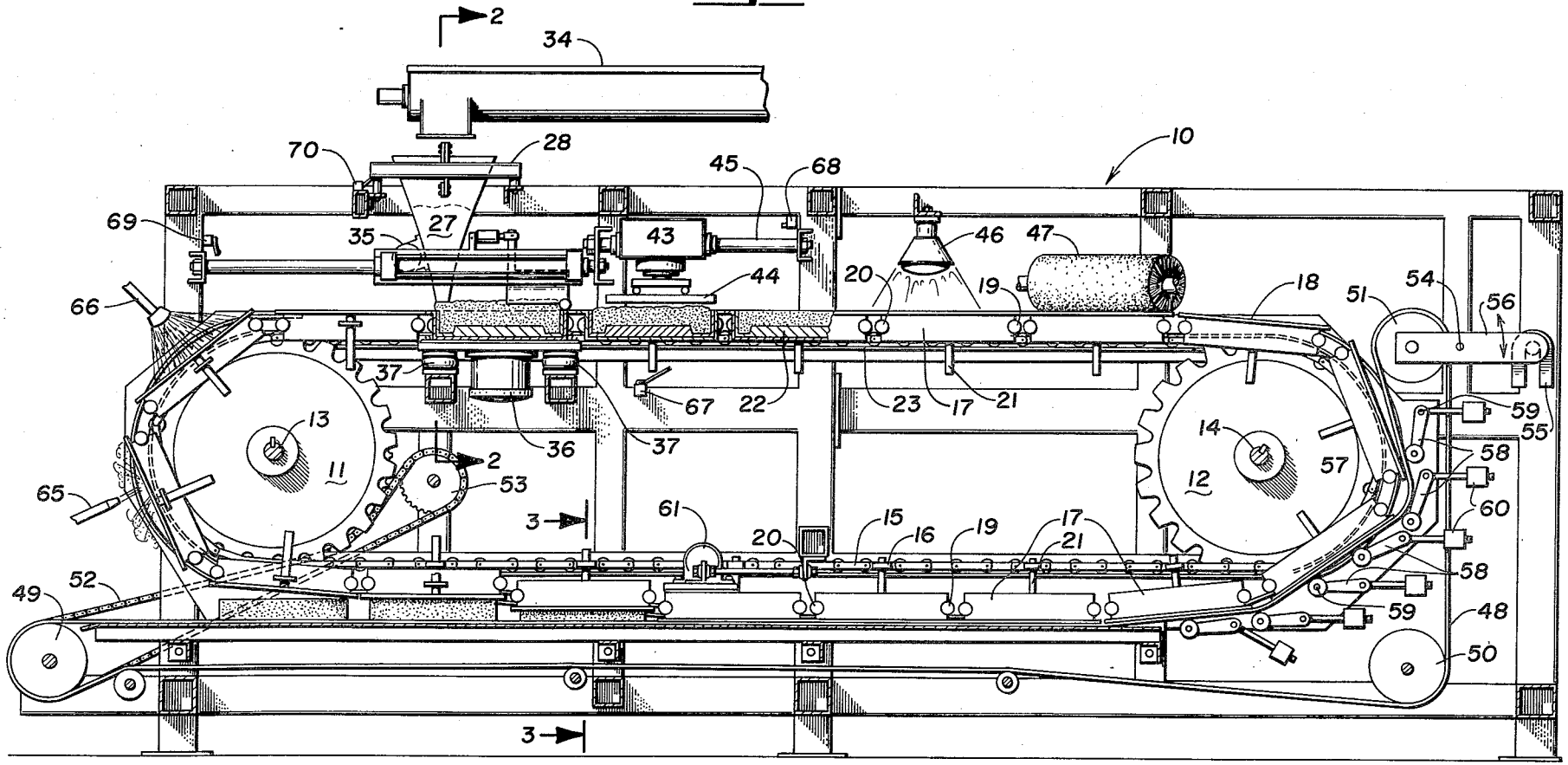
FIG. 1 is a side elevational view of apparatus in accordance with the invention with portions of the sides of the apparatus broken away to facilitate showing of internal portions thereof.

Turning now to the figures, like parts in the several figures will be given the same numerical designation. Referring first to FIG. 1, there is illustrated in side elevational view an apparatus in accordance with the present invention. A tubular steel frame generally designated 10 has rotatably mounted thereto by means of shafts 13 and 14 a drive sprocket wheel 11 and an idler wheel 12. Wheels 11 and 12 are each part of a pair of repectively of spaced wheels mounted to a common shaft defining therebetween the pathway for movement of flasks. An endless chain 15 passes about each of the drive wheels 11 and each of idler wheels 12 for rotation to form two spaced endless chain conveyors moving at the same speed. At spaced intervals along chain 15, there are provided gimble mounted sleeve bearings 16 as a portion of the chain.

Spaced along chain 15 are a plurality of flasks 17 which are joined for movement with chain 15 by means of guide pins 21 each of the flasks 17 has a pattern piece 22 associated therewith. Guide pins 21 slidably pass through the opening in gimble mounted sleeve bearing 16. At the forward and rear portions of the flask carrier 17, there is provided a shaft and roller wheel assembly 19 and 20 respectively extending outwardly from the sides of the mold carriers 17. Angle iron members 24 are joined to the sides of frame 10 so as to support the roller members 19 and 20. Rails 24 extend generally about the travel of the endless conveyor and are only changed in the draw position which will be described below. The endless chain 15 rides on a separate angle iron 23 and is supported thereby.

As can be seen in the Figures, the flask 17 are provided with flanges about the periphery of the open end thereof. These flanges 18 abutt one another from one flask to the next at the time the flasks are traveling along the upper course of the endless conveyor. This provides a continuous surface so that sand being delivered continuously from a spout does not drop between the individual carriers.

Figure 2:
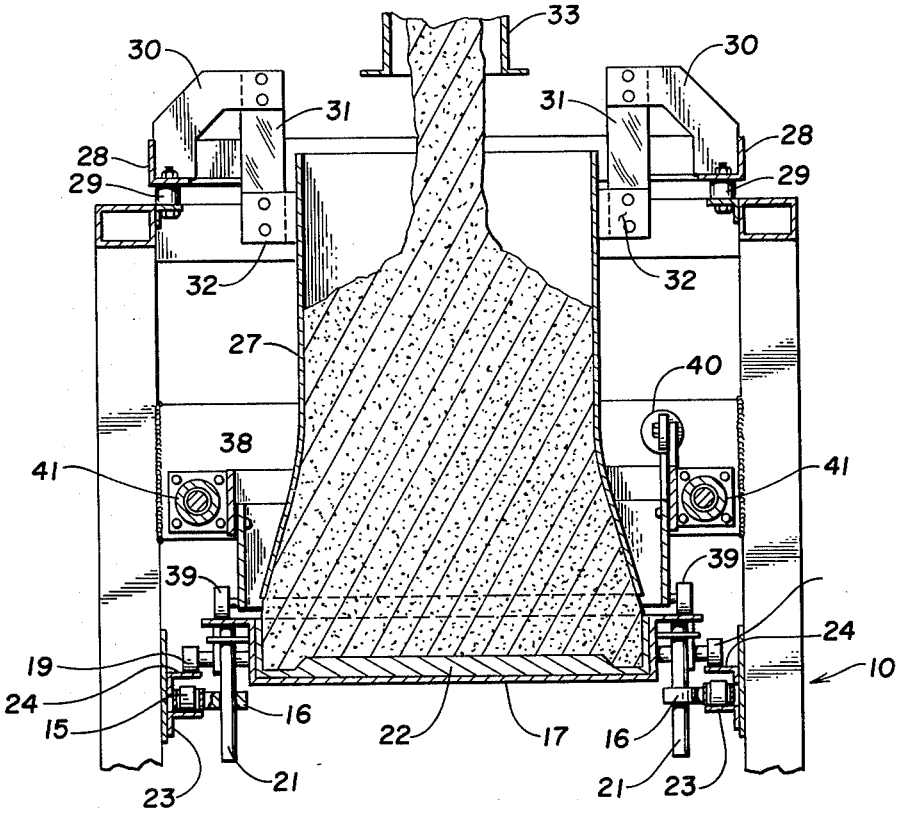
FIG. 2 is a sectional view along lines 2—2 of FIG. 1 showing the sand delivery hopper and scraper assembly.
Figure 3:
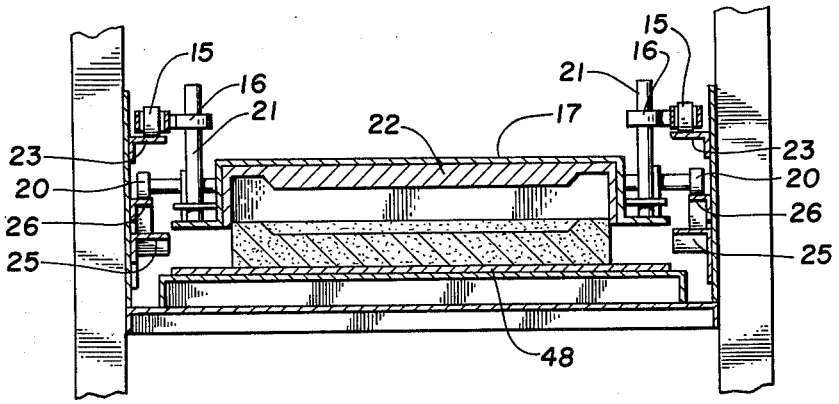
FIG. 3 is a sectional view along the lines 3—3 of FIG. 1 showing the release mechanism for the finished mold.

Mounted adjacent the upper course of the endless conveyor is a horn shaped sand hopper 27. Sand hopper 27 is fed with a mixture of sand and resin produced in a screw type mixer 34. Screw mixer 34 may be any of a variety of commercially available units such as a Minimix made by Fordath, Inc., of Portland, Ore. Freshly mixed sand and resin is dropped into hopper 27 which desirably has a horn shape when viewed from the side on FIG. 1 and a slight flare at the sides and lower end thereof as best seen in FIG. 2. The rate of feed of sand from the mixer 34 to hopper 27 is regulated so as to maintain the level of sand in the hopper 27 at a point near the top thereof. Various means may be utilized to sense the presence of an excessive quantity of sand in the hopper 27 so as to slow the delivery of mixed sand from the mixer. For example, a photo eye system passing through a region out of the path of falling sand binder and across the upper end of hopper 27, can be used in controlling the height of sand in hopper 27. If the sand level exceeds the desired height in hopper 27, the beam of light will be interrupted and the mixer delivery will be discontinued or slowed until the level of sand drops to the desired control point. Other means of level control will be readily apparent to those skilled in the art of sensing.

Alternatively, one may also use other means of filling the flasks with a sand-binder mixture. Either blow molding or the shooting of a preweighed charge of sand binder mix are two such alternative methods for filling of the flasks. It is also contemplated that one may have a mixer which produces the quantity of sand-binder mix necessary to create a single mold at each separate mixing step, that is, the mixing system shown at 34 is controlled so as to deliver a predetermined quantity necessary to fill an individual flask. By such a technique the sand binder hopper 27 is emptied at each successive mold and a somewhat reduced tendency exists to cause hang up of sand and binder within the horn 27. Also, in the event that there is some need to halt operation of the system one does not have the problem of an already mixed sand and binder reservoir that must be emptied so as to prevent set up of the mixture at some undesired point.

As previously noted various binder formulations may be utilized although the invention will be described specifically with regard to its use with no-bake binders. It should be appreciated that other sand-binder mixes can readily be adopted in the present apparatus. These include such systems as the chemcial cure type (carbon dioxide — silicate is one such).

Mounted to the side wall portion of hopper 27 is a vibrator 35 whose function is to assure a steady flow of sand outwardly from the lower opening in hopper 27. While various vibrating means may be utilized, one vibrator that has proven satisfactory is an electromechanical vibrator supplied by the Syntron Division of FMC Corporation under their No. RV 136.

As best seen in FIGS. 1 and 2, the sand-binder delivery assembly consists of the horn shaped funnel 27 which is suspended by means of ears 32 projecting from the side of horn 27, which ears are in turn connected to webbing strap hangers 31. Webbing straps 31 are in turn connected to support member 28. Support 28 is in turn joined by means of a bolt, rubber and grommet assembly 29 to frame 10. It should be noted that the horn member 27 is thus given limited movement so as to be pivotable about ears 32. The reason for such pivotal mounting will now be described.

As a flask 17 passes beneath the horn 27, sand is deposited therein until the sand level has reached the bottom opening on horn 27. Further, sand delivery is blocked once this level is obtained. However, as the flask 17 is moving with relationship to horn 27, sand is essentially continuously delivered. The rate of delivery is adjusted so as to insure a complete filling. Once the flask has been filled with the sand the horn is then positioned over the flanged edge of the next adjacent flask. At this point, a sensing means is triggered so as to activate a scraper assembly. Various types of sensing mechanism can be utilized to determine when the scraper assembly will be actuated. In FIG. 1, there is illustrated schematically a switch 57 which is tripped by guide pin 21 as a mold carrier passes by. The switch can be utilized to control actuation of the apparatus which will now be described.

It should be noted at this point that as the flask in 17 is being filled by hopper 27, flask 17 is in sliding engagement with a vibrating assembly positioned beneath the flask. The vibrator 36, which is cushion mounted to cross beam members of frame 10 by means of air bags 37, aids in compaction of sand as it enters into the flasks. These are various types of vibrating apparatus which can be utilized for this purpose. One such apparatus for purposes of the present description consists of an electro-magnetic vibrator manufactured by Syntron Division of FMC Corporation under their designation V-51B1. One may also utilize a tamper at the open top to aid in compaction of the sand-binder as it is fed into the flask.

Figure 5:
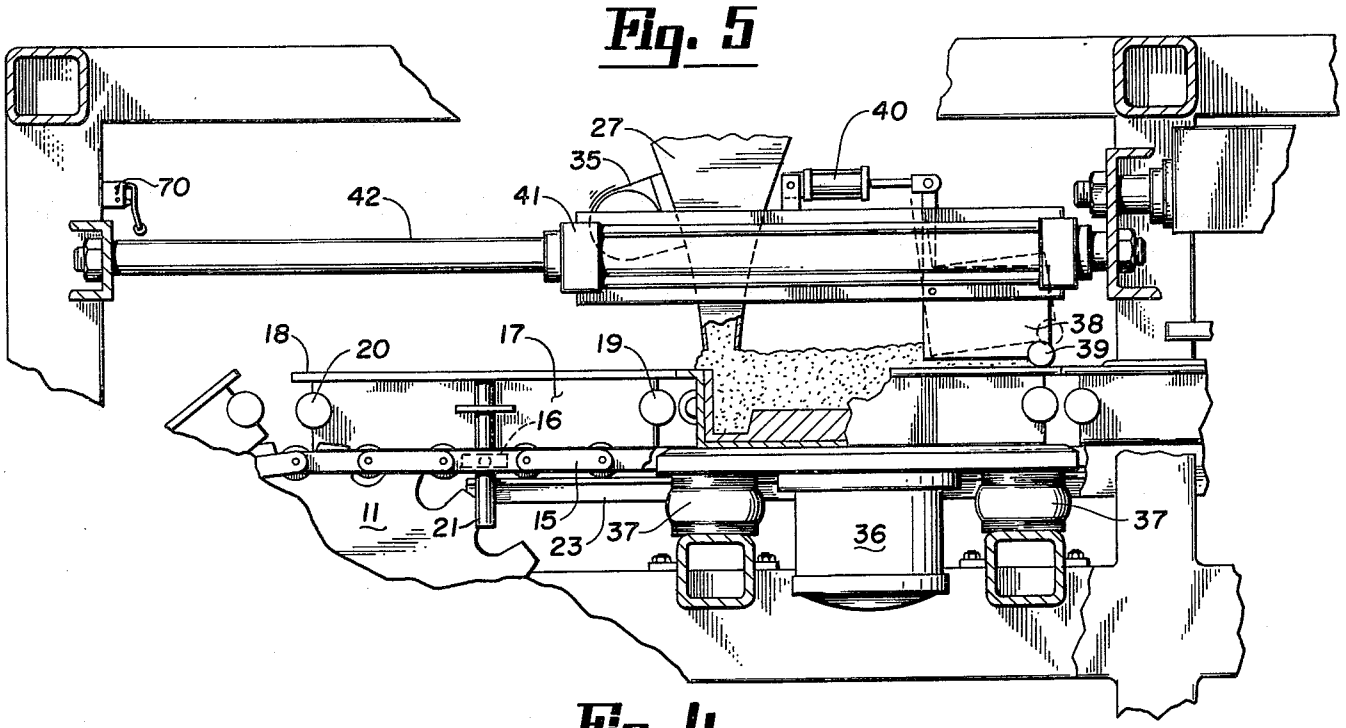
FIG. 5 is an enlarged side elevational view of the flask filling assembly of FIG. 1 with the portion of the side broken away to facilitate showing of the inner positioned portions of the scraper assembly.

Referring to FIG. 5, there is shown in somewhat enlarged view, the sand filling and scraper assembly. As the sand hopper and its vibrator arrangement have been previously described, they will not be described further here except as they interrelate to the scraper assembly.

The scraper arrangement will now be described. A "U"-shaped scraper member 38 is supported a predetermined distance above the flange 18 of the carriers 17 by wheel member 39. The upper end of the scraper 38 is joined to a small piston 40, which may conveniently be of a pneumatic type. Piston 40 is in turn mounted to a pneumatic drive assembly 41 which slidably engages a guide rod 42 which is mounted at its remote ends to frame assembly 10. Upon closing of switch 67, piston 41 is actuated by means not shown to move to the left of FIG. 5. As it moves through this stroke motion it draws scraper 38 across the surface of the filled mold carrier 17 to leave a predetermined level of sand-binding resin therein. The excess sand is swept into the next empty compartment. Note that excess sand-binder is not wasted as in some prior art apparatus. As the scraper 38 moves along the surface, it encounters hopper 27 which is pivotally mounted so as to be swingable away from the scraper 38. Scraper 38's movement does not carry it beyond the lower end of hopper 27 as it pivots. Once scrapper 38 has reached the end of its leftward travel, a limit switch 69 actuates a piston reversing mechanism (not shown). Piston member 40 is also actuated to tilt the rear edge of scraper 38 slightly upwardly for the return trip of the piston 41. This prevents any disturbance of the leveled surface of sand in the filled mold carrier.

An alternative construction to that immediately described above is to have horn member 27 operate on a cyclic filling arrangement as previously described above. In this type of an arrangement the horn will receive from mixer 34 only the quantity of sand-binker mix necessary to fill an individual flask. That is, the delivery of sand from mixer 34 is intermittent. In such construction, rather than having the horn member pivotally suspended from the main frame by means such as shown the horn 27 may be mounted to move with piston 41 along shaft 42. When horn member 27 is attached so as to be movable with piston member 41, the same operation takes place as described with respect to leveling of the sand mixture in a flask that has just been filled. However, in this arrangement the horn is completely emptied as it travels along with piston 41 into the succeeding flask in the manner to insure there is no hang-up of sand within the horn between individual fillings of flask. The horn returns along with piston 41 on the return stroke as described above and is once again in position beneath the spout of mixer 34 for receipt of the next batch of mixed sand-binder.

When a filled and leveled mold carrier has proceeded downstream so as to be in position beneath the presser plate assembly it actuates a sensor 67 by means of a guide 21. This sensor 57 atucates the presser assembly as well as leftward motion of the scraper 38 as previously described. Presser assembly 43 is mounted in sliding engagement with a guide rod 45 joined to frame 10. The presser assembly is not mandatory and will be useful primarily where it is desirable to have a very flat exterior surface to the cope or drag being manufactured. Pressure plate assembly 43 may conveniently be driven by pneumatic means so as to move in approximately synchronous relationship along guide rod 65 to the travel of conveyor 15. Upon actuaction of switch 67, the pneumatically driven plate member 44 presses down against the surface of the sand in a mold flask 17 to compact it further. It is desirable, although not required, to provide heating for the press plate 44 to minimize any tendency for clinging of sand particles to the press plate. When desired, presser plate 44 may be provided with an impression forming means to produce a shallow pattern on the bottom side of the mold being formed. The presser plate may also include a manifold for introduction of a gas for curing of the binder in the sand.

The presser assembly 43 travels along rod 44 during the pressing operation. A limit switch 68 is encountered by press plate assembly as it reaches the terminous of its travel thereby actuating relaease mechanism, (not shown) which removes the pressure on press plate 44 and allows press assembly 43 to travel back to its position as shown in FIG. 1.

The now filled and densified flask progresses further to the right along conveyor 15. If it is desired to form a tougher skin on the surface of the exposed sand, one may utilize heating means such as infrared lamp 46 to aid in the surface curing of the resin-sand mixture. Following this step, a conventional roller drum brush 47 may be used to sweep the surface of the filled mold carrier to remove any loose sand particles.

The flask then progresses about the curved portion defined by idler wheel 12 as shown in FIG. 1. As it does so, the exposed sand surfaces comes into engagement with a second conveyor belt assembly which provides a multiple number of functions. This belt assembly will now be described in some detail.

An endless belt 48 having a continuous surface such as a rubberized fabric which is of a width to cover the opening in flask 17 passes about a drive wheel 49 and idler wheels 50 and 51 which are positioned as shown. Drive wheel 49 is desirably coupled by means of a chain drive 52 which is in cooperative arrangement with a drive portion of wheel 11 by means of an idler wheel 53. Substantially synchronous movement of belt 48 and chain 15 is thus obtained. Belt 48 is maintained in appropriate tension by means of a pivotal mounting of wheel 51 about pivot point 54. A balance weight 55 pivots arm 56 which supports idler wheel 51 to take up any slack which may occur due to varying positions of flask 17 as they progress about the endless conveyor.

There is also provided a plurality of roller and counter balancing assemblies for holding belt 48 in firm engagement with upper surface of flasks 17 to provide a closure therefor. These assemblies consist of rollers 57 which are a width to extend substantially across the width of belt 48. Rollers 57 are rotatably joined to arms 58 which are free to pivot about pivot point 59. The arms 58 are fixedly joined to counter balancing weight member 60 so that the roller members are maintained in substantially constant pressure relationship with the belt 48 which is in turn held in closure relationship with opening in flask 17.

Thus, as the now filled flask passes about the idler wheel 12 the sand is held in position by means of belt 48 and by substantially synchronous motion of the belt and flask 17 is inverted and placed in postion for draw of the sand mold.

Alternative construction of the inverting portions of the apparatus may also be used. For example, belt 48 may have a width considerably less than that of the opening in flask 17 and still provide the required restraining function of preventing the molded sand from falling prematurely out of the flask. Providing that cure of the bonding material has progressed to a point where it is reasonably firm, then only a small area contact is required to hold the sand mold within the flask. Thus, belt 48 may be a single narrow width member occupying less than the whole opening in the flask 17. It may also consist of a plurality of narrow parallel spaced strip members which contact spaced segments of the sand-binder in the flask 17 as it rotates about the inverting end.

It is also contemplated to utilize an open mesh member for belt 48. Such a belt will function to hold the sand-binder mixture in the flask provided, of course, that at least the exposed surface of the sand-binder has cured to some extent.

Figure 6:
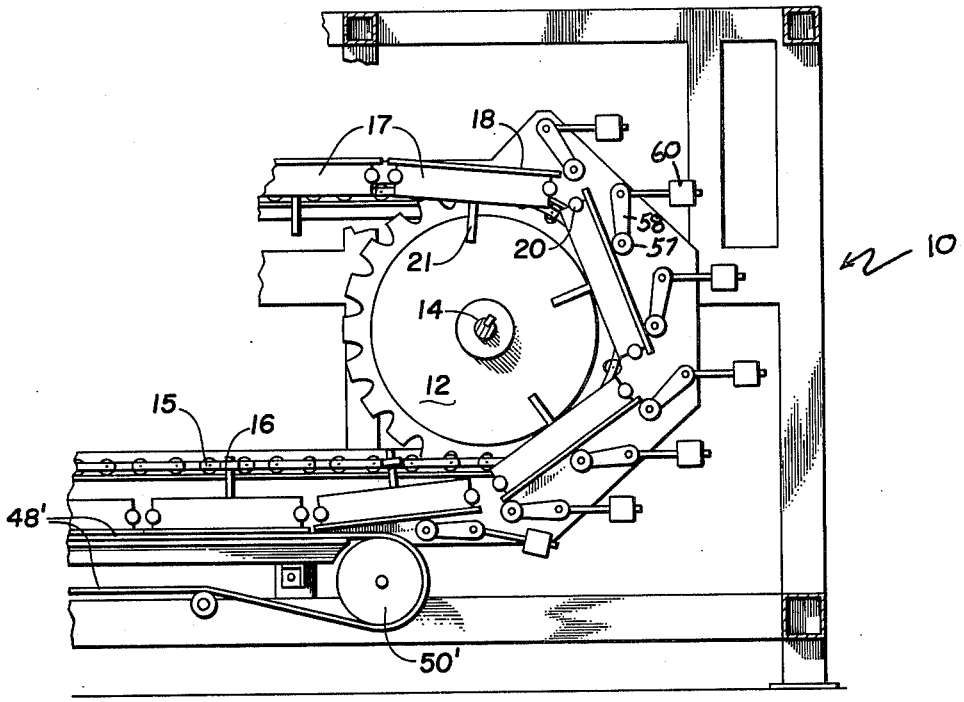
FIG. 6 is a partial side elevational view of an alternative construction for holding the sand-binder mix in the flask during inversion; and, FIG. 7 is a partial elevational view of another alternative construction for the inverting portion of the assembly.

The holding function provided by belt 48 at the inverting stage can be performed solely by the roller 57 and counterbalancing assembly 58. Such a construction is illustrated in FIG. 6. As shown therein belt 48 is no longer used and the roller assemblies 57 - 58 are the means for maintaining a pressure contact with the surface of the sand-binder to prevent same from prematurely coming out of the flasks 17. A binder will have to be used which is cured at at least the surface thereof to a degree that it will supportively bind the sand to a sufficiently cohesive degree to a not disintegrate during the inversion step. As the flask carrier completes its inversion it comes into engagement with a continuous conveyor belt 48 which passes about an idler wheel 50. The balance of conveyor belt 48 and the mold drawing operation are the same as will be described with regard to FIGS. 1 and 4.

Figure 4:
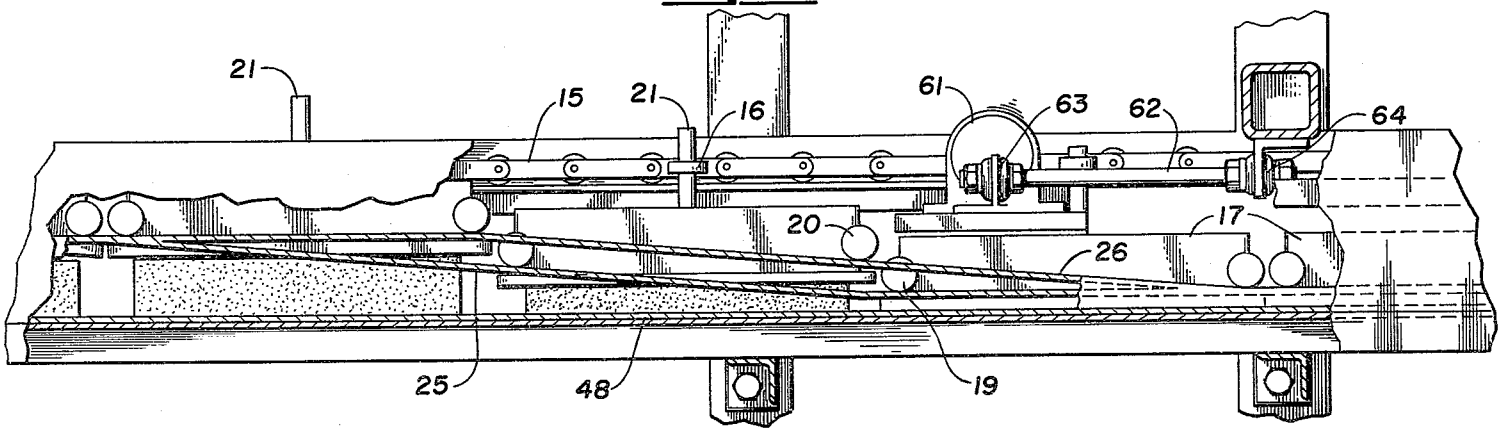
FIG. 4 is an enlarged side elevational view of the lower portion of the endless conveyor with a portion broken away to show the mechanism for separating the sand mold from the flask.

The drawing operation is best seen in FIG. 4. As can be seen therein as the flask 17 progresses to the left along belt 48 (or alternatively belt 48) and by synchronous movement of chain 15, it passes beneath and its bottom is engaged by an electromechanical vibrator 61. Vibrator 61 is mounted to a shaft member 62 which passes through rubber grommets 63 and 64 respectively so as to permit some movement of vibrator 61 in an arcuate fashion. As the inverted flask 17 passes beneath vibrator 61, wheels 19 encounter a parallel ramp 26. As can be seen, the raising motion lifts flask 17 free of belt 48 while simultaneously vibrator 61 aids in freeing the sand mold that has now been cast from the flask 17. As can also be seen, guide pins 21 slidably proceed upwardly through gimble mounted sleeve bearing 16. The now freed sand mold proceeds along belt 48 to the end thereof where it is removed or transferred to some additional operation.

The now emptied flask continues about the periphery of the drive wheel 11. Electric eye sensing means may be utilized to insure that a sand mold has in fact been freed from the flask 17 during the drawing operation.

As the now emptied flask 17 proceeds along drive wheel 11, one may provide a cleaning means such as a jet spray of the air schematically illustrated at 65 to spray any loose particles of sand that may remain in the flask free therefrom. The flask then proceeds further around the drive wheel 11 and may be sprayed as required with a mold release at a mold release spray 66. The cycle is then ready for a repeat.

Figure 7:
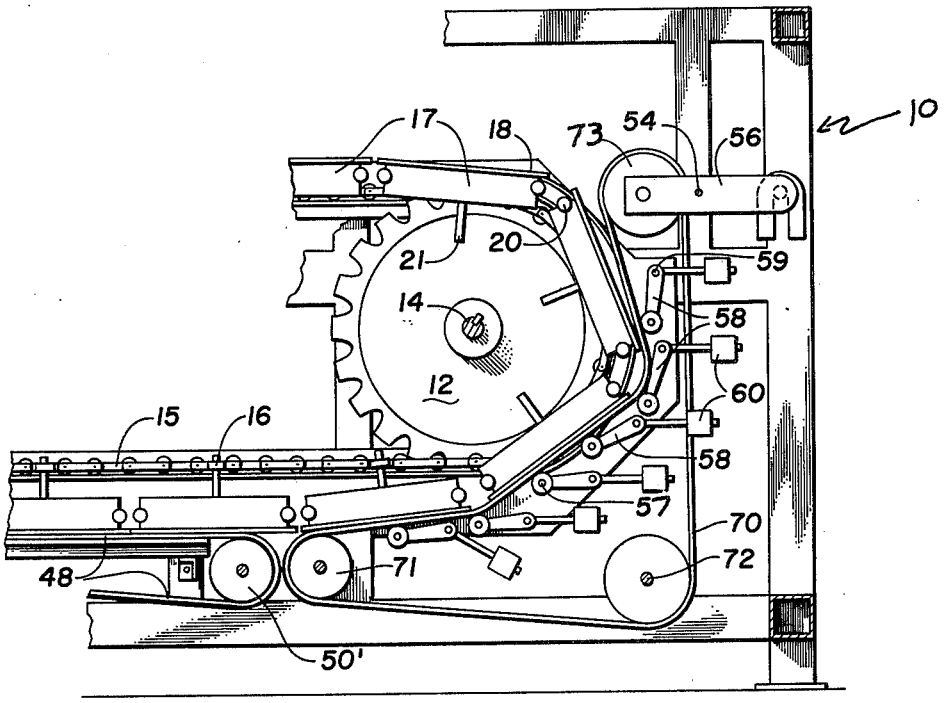

Other constructions may also be used in the inverting stage. For example, as shown in FIG. 7, the inverting conveyor holding means may be a separate belt from that which passes beneath the major length of the casting machine. As shown in FIG. 7, a belt 70 passes about wheels 71, 72, and 73 as shown. One of these wheels, preferably wheel 71, is a driven wheel which is caused to rotate by a means, not shown, at a rate to substantially synchronize belt 70 with the conveyor chain 15. As the flasks complete their inversion while in contact with belt 70 they are transferred to a second belt 48 corresponding to the conveyor belt 48 of FIG. 6. The drawing operation is the same as previously described.

What we claim is:

1. Apparatus for the automatic manufacture of sand molds, cores or the like for use in casting foundry pieces, comprising a first continuous conveyor having a plurality of pattern pieces and flasks attached thereto, each of said flasks being movable with said conveyor from a vertically upright position through an inverted position and back to an upright position, means connected to said flask and pattern pieces for mounting said flask and pattern pieces on said first conveyor for limited vertical movement with respect thereto, and guide means on said first conveyor for operating with said mounting means for guiding the limited vertical movement, means adjacent said first conveyor for filling each of said flasks with sand-binder mixture when each flask is in an upright position at a filling location, means adjacent said first conveyor for compacting said sand-binder mixture into a filled flask, a second conveyor disposed below said first conveyor and operable to cooperate with said flasks of said first conveyor system when said flasks are in said inverted position, said flasks and said sand molds, cores or the like therein being brought into abutting engagement with said second conveyor when said flasks are moved into said inverted position after at least partial curing of the binder of said sand-binder mixture so that the sand-binder mixture in said flask will remain intact as a sand mold, core, or the like when inverted and separated from said flask, and means adjacent said second conveyor for effecting release of said sand molds, cores, or the like from said flasks when said flasks are in an inverted position and displaced with respect to said first conveyor said means including means for moving said flasks away from said second conveyor and toward said first conveyor to separate said molds from said flasks completely, each of said flasks in turn being moved back into an upright position for receipt of further sand-binder mixture therein while said formed sand molds, cores, or the like are conveyed away by said second conveyor.

2. Apparatus as recited in claim 1 wherein said means for effecting release of said sand molds, cores, or the like from said flasks when said flasks are in an inverted position further include vibrating means for engaging and vibrating each of said inverted flasks in turn while said flasks are in substantial abutting engagement with said second conveyor.

3. Apparatus as recited in claim 1 wherein said means for moving said flasks away from said second conveyor and toward said first conveyor comprises roller means mounted on said flasks on either side thereof, and roller track means for engaging said rollers and effecting movement of said flasks with respect to said first and second conveyors.

4. Apparatus as recited in claim 1 wherein each of said flasks has a flange on the upper surface thereof extending in the direction of movement of said flasks by said first conveyor at said filling location, said flanges of consecutive flasks extending in abutting engagement with each other at said filling position so that sand-binder mixture may be continuously discharged by said filling means without deposition thereof outside of said flasks.

5. Apparatus as recited in claim 4 further comprising means for leveling off the amount of sand-binder mixture is each of said flasks after filling thereof and before compacting thereof.

6. Apparatus as recited in claim 1 further comprising means adjacent said first conveyor for facilitating curing of said binder of said sand-binder mixture and means adjacent said first conveyor for sweeping the surface of the sand-binder mixture in each of said flasks to remove loose particles therefrom, both of said means operating on said sand-binder mixture in said flasks when said flasks are in an upright position.

7. Apparatus as recited in claim 1 wherein said means for mounting said flasks and pattern pieces for limited vertical movement with respect to said first conveyor and said guide means include a plurality of rods and collars for receipt of said rods, extending between portions of said conveyor and said flasks.

8. Apparatus as recited in claim 1 wherein said means for moving said flasks vertically away from said second conveyor and toward said first conveyor comprises roller means mounted on said flasks on either side thereof, and stationary roller track means mounted between said first and second conveyors disposed at an incline and for engaging said roller means of said flasks in turn and thereby vertically displacing said flasks and pattern pieces with respect to said first and second conveyors.

9. Apparatus as recited in claim 1 further comprising means holding said second conveyor into engagement with said sand-binder mixture in each of said filled flasks at all times as said flasks are moved from said upright position to said inverted position to retain said sand-binder mixture in said flasks during inverting so that the formed molds, cores, or the like will be intact when disposed on said second conveyor.

10. Apparatus as recited in claim 9 wherein said second conveyor include a conveyor belt and said holding means comprises pressure means for holding said belt against a portion of said sand-binder mixture in each flask in turn at all times during inversion.

11. Apparatus as recited in claim 1 further comprising a plurality of rollers for holding said sand-binder mixture in each of said filled flasks at all times as said flasks are moved from said upright position to said inverted position to retain said sand-binder mixture in said flasks during inverting so that the formed molds, cores, or the like will be intact when disposed on said second conveyor, and pressure means for holding said rollers against a portion of said sand-binder mixture in each flask in turn during inversion.

* * * * *